US006453909B1

(12) United States Patent
De Laforcade

(10) Patent No.: US 6,453,909 B1
(45) Date of Patent: Sep. 24, 2002

(54) APPLICATOR, KIT, AND METHOD FOR APPLYING HAIR COLORING

(75) Inventor: Vincent De Laforcade, Rambouillet (FR)

(73) Assignee: L'Oreal S.A., Paris (FR)

( * ) Notice: Subject to any disclaimer, the term of this patent is extended or adjusted under 35 U.S.C. 154(b) by 0 days.

(21) Appl. No.: 09/525,532

(22) Filed: Mar. 15, 2000

(30) Foreign Application Priority Data

Mar. 15, 1999 (FR) ..... 99 03173

(51) Int. Cl.[7] ..... A61K 7/13; A45D 24/22; A45D 24/16

(52) U.S. Cl. ..... 132/208; 132/114; 132/120; 132/116

(58) Field of Search ..... 132/208, 317, 132/320, 202, 207, 209, 109, 111, 112, 113, 114, 115, 116; 15/160, 186, 187, 188, 166, 167.1

(56) References Cited

U.S. PATENT DOCUMENTS

| | | | | | |
|---|---|---|---|---|---|
| D41,870 | S | | 10/1911 | Homan | |
| D46,754 | S | | 12/1914 | Smith | |
| D54,565 | S | | 3/1920 | Stiles | |
| D68,587 | S | | 10/1925 | Nevius | |
| 1,597,855 | A | * | 8/1926 | Zahorsky | 132/112 |
| 2,217,439 | A | * | 10/1940 | Fuller | 15/110 |
| 2,218,862 | A | | 10/1940 | Vredenburgh | |
| 3,008,164 | A | | 11/1961 | Herman et al. | |
| 3,640,288 | A | | 2/1972 | Spanel | |
| 3,843,991 | A | | 10/1974 | Vallis | |
| 3,960,160 | A | | 6/1976 | Hogan | |
| 4,694,525 | A | | 9/1987 | Yamamoto et al. | |
| 4,881,558 | A | | 11/1989 | Hollenberg et al. | |
| 5,062,435 | A | * | 11/1991 | Ohtsuka | 132/108 |
| 5,337,765 | A | | 8/1994 | Wong | |
| 5,628,082 | A | * | 5/1997 | Moskovich | 15/110 |
| 5,930,860 | A | * | 8/1999 | Shipp | 15/110 |
| 6,009,881 | A | * | 1/2000 | Baudin et al. | 132/112 |
| 6,142,157 | A | | 11/2000 | de Laforcade | 132/208 |

FOREIGN PATENT DOCUMENTS

| | | |
|---|---|---|
| EP | 0 474 934 | 3/1992 |
| EP | 0 890 326 | 1/1999 |
| FR | 726 157 | 5/1932 |
| FR | 2 728 444 | 6/1996 |
| FR | 2 774 570 | 8/1999 |
| JP | 3-128004 | 12/1991 |
| JP | 9-154625 | 6/1997 |
| JP | 11-266921 | 10/1999 |
| WO | WO98/43511 | 10/1998 |

OTHER PUBLICATIONS

English language Derwent Abstract of EP 0 890 326.
English language Derwent Abstract of FR 2 728 444.
English language Derwent Abstract of FR 2 774 570.

* cited by examiner

*Primary Examiner*—John J. Wilson
*Assistant Examiner*—Robyn Kiew Doan
(74) *Attorney, Agent, or Firm*—Finnegan, Henderson, Farabow, Garrett, & Dunner, L.L.P.

(57) ABSTRACT

An applicator is provided for applying a hair product, for example, a hair coloring product in the form of a gel or of a cream. The applicator includes an array of brush members, such as teeth or bristles, on an application face. The application face is preferably impermeable to the hair product and is capable at least temporarily holding the product that is to be applied to the hair. The application face has a stepped profile with at least two discrete levels so that contact of the application face with the hair, and movement thereof between the roots and the tips of the hair, generates on the hair a coloration pattern which is formed of at least two locks of hair having different degrees of coloration.

81 Claims, 4 Drawing Sheets

FIG. 2A
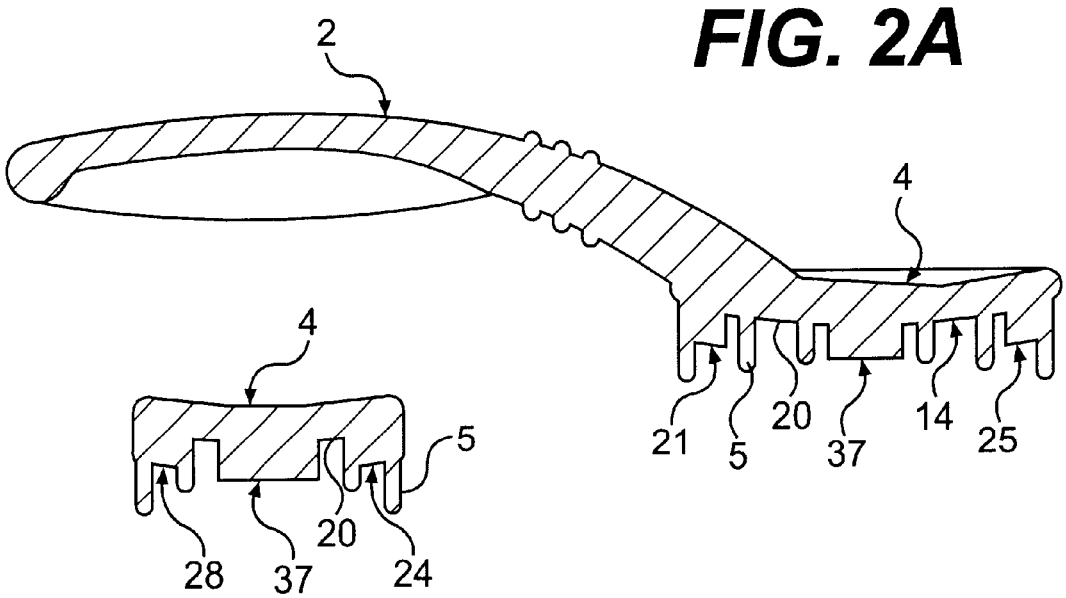
FIG. 2B
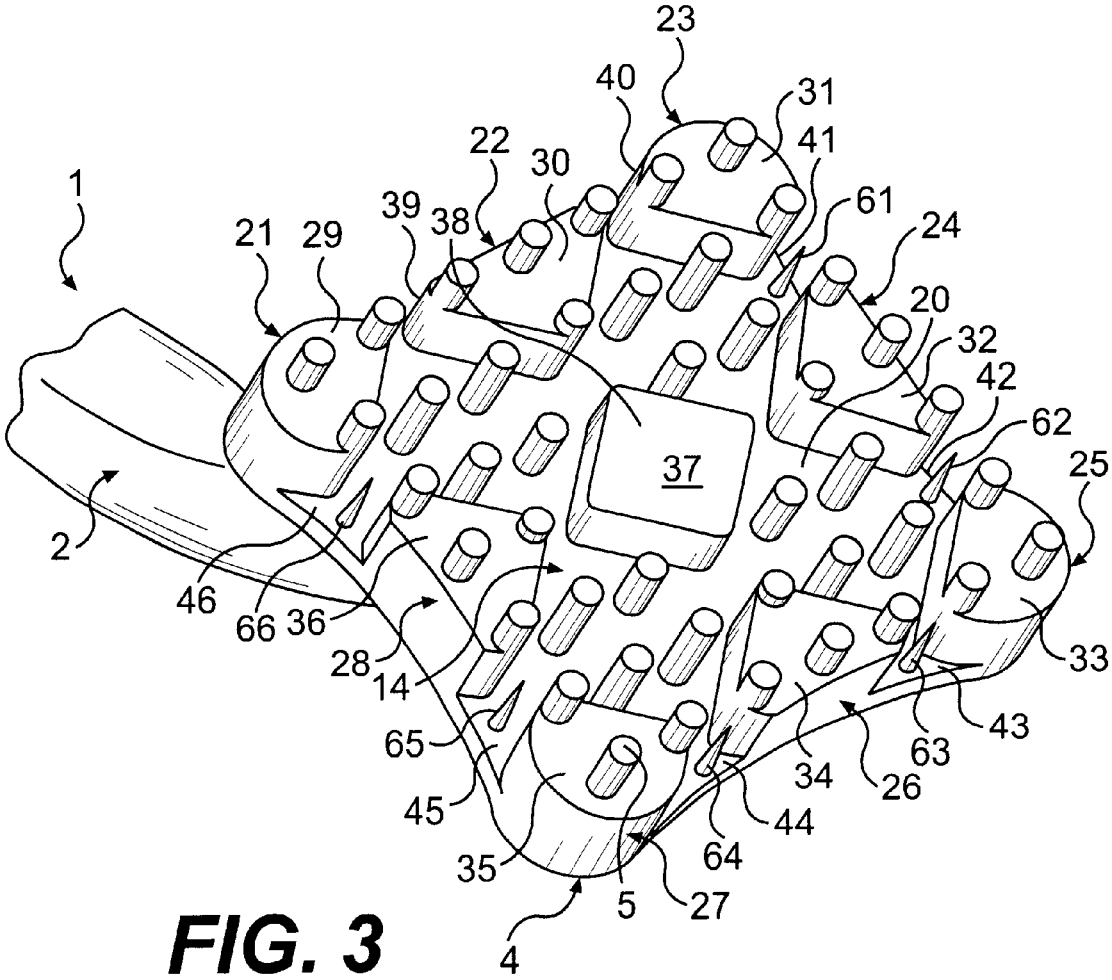
FIG. 3

APPLICATOR, KIT, AND METHOD FOR APPLYING HAIR COLORING

The present invention relates to an applicator for applying a hair coloring product, particularly one in the form of a mousse, gel or cream.

The compositions that can be used with the applicator according to the present invention may be packaged, for example, in mixing devices suited for the extemporaneous mixing of various constituent components (generally a colorant and an oxidant), or in a bowl in which mixing is performed manually, or in pressurized containers. In particular, they preferably have a viscosity similar to that of a gel or a cream. An example of a coloring product of this kind is the product marketed, particularly in France, by the assignee of the present application, under the tradename FERIA CONTRASTE®.

It is known practice for a hair product to be applied to the hair using a brush comprising a support forming a continuous surface and which may be domed in shape. Brush members (teeth or tufts of bristles) are provided at right angles to a mean plane of the support. The support may, for example, be of square cross section with two of its corners aligned along an axis of the handle. An arrangement of this kind makes it possible for the brush to have no leading edge parallel to the handle or perpendicular to the handle, and this plays a part in satisfactorily solving the problem of "lines" which may occur when applying certain coloring products. A brush of this kind is described in FR 2 774 570.

The use of such a brush, although satisfactory overall, does however reveal that for certain consumers satisfactory hair coloration is sometimes difficult to obtain. Specifically, the continuous surface formed by the application face means that certain users obtain an overall coloration instead of a streaked coloration they intended.

In a field other than hair coloring, U.S. Pat. No. 5,062,435 discloses a device which allows wetting the hair with a view to untangling it or to applying to it a tonic or cleaning composition. The device described in that document comprises a structure made of several parts joined together in an appropriate way. This structure is made up of an arrangement of teeth intended to comb the hair, in combination with one or more elements made of absorbent foam intended to contain the liquid composition that is to be applied to the hair. Because the product is retained within a porous application structure permeable to the product, it is not possible for simple application of the product to the hair. This is because when the block of foam is saturated with a liquid composition, all of the hair is inevitably in contact with the composition in a fairly uniform manner, in spite of the toothed shape of the foam structure. Thus, if the liquid composition were a coloring composition, it would not be possible to perceive any appreciable difference in coloration between one section of hair and a nearby section of hair.

Thus, one object of the present invention is to provide an applicator for applying a coloring product (including a color removing product) to hair which at least partially solves the problems discussed above with reference to certain known devices.

A particular object of the present invention is to provide an applicator of this kind which is both economic to produce and easy to use.

Another object of the present invention is to provide a brush which offers a great deal of flexibility to obtain sectional or streaked coloration of the hair.

Yet another object of the present invention is to produce a kit for applying a hair product, particularly a hair color product, incorporating an applicator device according to the present invention.

It should be understood that the invention could still be practiced without performing one or more of the preferred objects and/or advantages set forth above. Still other objects will become apparent after reading the following description of the invention.

To achieve these and other advantages, and in accordance with the purposes of the invention, as embodied and broadly described herein, the invention includes applicator. According to the invention, an applicator for applying a hair coloring product, particularly in the form of a gel or of a cream, to hair, comprises an array of brush members (teeth or bristles) implanted on an application face of a support, the application face being impermeable to the coloring product and capable of taking up the product that is to be applied and of holding it, at least temporarily. The application face has a stepped profile with at least two discrete levels so that contact of the application face with the hair, and movement thereof between the roots and the tips of the hair, generates on the hair a coloration pattern which is formed of at least two sections of hair which have different degrees of coloration. In the case of a brush formed of bristles, the bristles are generally arranged in the form of tufts.

As used herein, the degree of coloration of a section of hair may range from an absence of coloration, at least an absence of visible coloration, to a coloration of maximum intensity as may result from completely immersing the sectioned hair in the coloring product. The difference in degree of coloration between the hair in the coloration pattern may be particularly visible to the naked eye. The term "coloration" as used herein covers both adding color to and removing color from the hair. The length of time for which the product that is to be applied is held on the application surface depends to a large extent on the viscosity of the product and on the profile formed by the application face.

Producing the profile of the application face, which is impermeable to the product, in a stepped or discontinuous shape means that, for all the hair which will contact the application face as the device is passed through the hair, some of the hair will be confined, for example by the presence of the teeth or bristles, in deep regions of the application face containing a great deal of coloring product and will therefore be intensely colored. Some hair may contact intermediate surface portions of the application face carrying little product (for example, product which has spilled over from the deep regions), and will therefore be colored with an intermediate intensity. Other hair may contact raised surface portions which have no product in any appreciable quantity. Such hair will then be held away from the product contained in the other regions. As a result, the hair on these sections will not be appreciably colored. It will thus be possible to produce alternating sections of hair which are intensely colored and sections of hair which are not appreciably colored, possibly separated by regions of hair having intermediate coloration, giving the hair that has been in contact with the application face a streaked appearance.

As a preference, the sections of hair of the various coloration intensities obtained are contiguous. Thus, the end result obtained is very natural and irregular coloration. At the same time, by altering the layout of the steps of the application face, the number of steps, and their height, and by altering the orientation of the application face of the applicator, the result obtained is very different from the result obtained with coloration devices of the type which "trap" the hair, which produce hair section coloration of the "all or nothing" type, that is to say hair sections which are either colored or are not colored at all.

Thus, according to a first embodiment, the stepped profile is such that the coloration pattern obtained is made up of at least one colored hair section and of at least one hair section which is not appreciably colored.

According to an alternative embodiment, the stepped profile includes at least three discrete levels, so that the coloration pattern also comprises at least one hair section, the degree of coloration of which is in between the degree of coloration of the colored hair section and that of the hair section which is not appreciably colored.

Advantageously, the stepped profile formed by the application face is such that the pattern obtained varies according to the orientation of the support and/or to the direction in which the support is moved. Thus, the stepped profile formed by the application face may be chosen so that the number of colored hair sections varies according to the orientation of the support and/or to the direction in which it is moved. Furthermore, the stepped profile formed by the application face may be chosen so that the width of the colored hair sections varies according to the orientation of the support and/or to the direction in which it is moved. Thus it is possible, depending on the orientation of the support with respect to the direction in which it is moved, to alter, in particular, the number of hair sections which are intensely colored, their width, and the definition of the edges which define them. The edge may be sharp or soft.

As a preference, the brush members (teeth or bristles) are directed approximately at right angles to a plane of the support, their free ends located at the opposite end to the support being arranged in an envelope surface of concave shape, the brush members being arranged on the convex side of the envelope surface. Thus, when the envelope surface formed by the free ends of the brush members (teeth or bristles) contact the scalp, it perfectly follows the contour thereof.

According to a particular embodiment, the application face is made up of a base surface forming the bottom of at least one recessed portion of the application face and of a number of intermediate surface portions made up of a number of first raised portions of the application face, the intermediate surface portions being formed at a height that is in between the level of the base surface and the level of the free end of the brush members (teeth or bristles).

Advantageously, the intermediate surface portions are noncontiguous and separated from each other by a recessed portion of the application face. Thus, a hair section brought into contact with a recessed portion containing a great deal of product is intensely colored. A hair section brought into contact with an intermediate surface, which carries only a small amount of product just the product which has spilled over from the neighboring recessed portions) is lightly colored, in comparison to that which is intensely colored. The hair section preferably cannot move from a recessed portion to a raised portion, and vice versa, because, on the one hand, the application face has a profile in discrete levels or steps and because, on the other hand, of the brush members. The discontinuity between the various surface portions of the application face is advantageously obtained by separating the base surface from the raised surface portions using surface panels directed approximately parallel to the direction of the brush members.

Advantageously, the application face further includes at least one second surface portion made up of at least one second raised portion, the intermediate first surface portions extending along a mean height level that lies between the mean height level of the base surface and the mean height level of the second surface portion(s). Thus, all of the product deposited on the application face is preferably below the level of the surface formed by the at least one second raised portion. Preferably, a section of hair which engages with such a second surface portion will be kept away from the coloring product and will thus not be appreciably colored.

As a preference, the second surface portion is a center surface portion located at the approximate center of the application face.

As a preference, the at least one second surface portion is contained in the envelope surface formed by the free end of the brush members (teeth or bristles).

According to one advantageous feature of the invention, the base surface is of convex shape, the brush members (teeth or bristles) being arranged on the convex side of the base surface. Such a configuration makes it possible at the time of application, by pivoting the handle about its axis, to apply all of the product that lies on the application face. For the same reasons, the first surface portions preferably fall within a surface that is "concentric" with the base surface.

According to a preferred embodiment, the at least one recessed portion of the application face forms at least one so-called region of "intense coloration" extending continuously between two points on the periphery of the support, and to which they open via a passage formed between two raised portions of the application face. Such an "intense coloration" region preferably runs in a straight line.

Structure may be provided in the passages to encourage the retention of the hair coloring product on the base surface. This makes it possible, particularly in the case of products of slightly lower viscosity, to impede the flow of product from the application face, or at least to slow it down, while at the same time not hampering the engagement of the hair with the various regions of the applicator. Furthermore, this does not disturb the movement of the applicator through the hair, and does not alter the coloration of the section of hair in question.

By way of example, the retention structure includes one or more brush members (teeth or bristles) arranged approximately at the center of each passage.

Advantageously, the support is integral/unitary with a handle having a longitudinal axis, the cross section of the application face parallel to a plane of the support being of approximately square shape, two of the corners of the application face being aligned along the longitudinal axis of the handle. This produces a preferred structure which has no edges approximately parallel or at right angles to the axis of the handle, which plays a part in making the application more natural. However, other shapes may be envisaged, particularly circular or triangular shapes.

The brush members (teeth or bristles) are advantageously arranged in rows formed at an approximately 45° angle with respect to the longitudinal axis of the handle. This characteristic is particularly advantageous in that it plays a part in obtaining coloration patterns which differ according to the orientation of the support and with respect to the direction in which it is moved.

More specifically, the intermediate surface portions are formed of "blocks" or "sets" arranged at the four corners of the application face and in the middle of each of the four edges of the application face. The shape of the blocks is suitably chosen so that they define between them the recessed portions preferred to achieve for the desired result.

As a preference, a second surface portion is provided in the form of a block arranged at the approximate center of the application face. A block of this kind may be of approximately square cross section and is defined by four edges which are offset by 45° with respect to the edges of the application face. A configuration of this type plays a part in obtaining colored sections of hair, the width of which varies according to the orientation of the support and/or to the direction in which the device is moved through the hair.

According to a specific embodiment, the application face may comprise eight first "intense coloration" regions, running continuously, and in pairs, from one edge of the application face to another adjacent edge of the application face. Furthermore, the application face may include four second "intense coloration" regions running continuously, and in pairs, from one edge of the application face to another opposite edge of the application face.

As a preference, the first "intense coloration" regions are smaller in width than the second "intense coloration" regions.

The edges of the application face may be of slightly concave shape. This characteristic makes the application all the more natural. The applicator according to the present invention may be obtained by molding a thermoplastic, particularly a polypropylene or a polyethylene.

According to another aspect, the invention also relates to a kit for applying a product for coloring hair in hair, comprising a device for packaging the product and an applicator device according to the invention. The packaging device may include, in particular, a bowl, a mixer or a pressurized container.

According to one aspect of the present invention, the applicator comprises a support including an application face impermeable to the hair coloring product, and an array of brush members on the application face, the application face being configured to at least temporarily hold the hair coloring product and having a stepped profile including at least two discrete levels configured such that contact of the application face with hair to be colored and movement of the application face between roots and tips of the hair to be colored generates on the hair a coloration pattern including at least two sections of hair having different degrees of coloration.

According to another aspect of the invention, a method of applying a hair coloring product to hair with an applicator having an application face and brush members on the application face, the application face having a stepped profile including at least two discrete levels is provided. The method comprises placing the hair coloring product on the application face, positioning the applicator such that the application face faces the hair to be colored, contacting the hair to be colored with the application face, and moving the applicator between roots of the hair and tips of the hair to transfer the hair coloring product from the application face to the hair and thereby produce a coloration pattern including at least two sections of hair having differing degrees of coloration.

According to yet another aspect of the present invention, the applicator comprises an application face having a base surface, brush members on at least a portion of the base surface, a raised center surface portion on the application face, and at least one intermediate surface portion on the application face located in a plane between a plane of the base surface and a plane of the center surface portion.

According to a further aspect of the present invention, the applicator comprises a handle, and a support on the handle, the support including an application face configured to at least temporarily hold the hair coloring product and having a stepped profile including a base surface, at least one intermediate surface portion, and an upper surface portion configured to produce a coloration pattern including at least two sections of hair having differing degrees of coloration on hair to be colored, wherein the upper surface portion extends further than the intermediate surface portion from a plane of the support.

Beside the structural arrangements set forth above, the invention could include a number of other arrangements, such as those explained hereinafter. It is to be understood that both the foregoing description and the following description are exemplary, and are intended to provide further explanation of the invention as claimed.

The accompanying drawings are included to provide a further understanding of the invention and are incorporated in and constitute a part of this specification. The drawings illustrate embodiments of the invention and, together with the description, serve to explain the principles of the invention. In the drawings, FIG. 1 is a top view of an applicator device according to one embodiment of the invention;

FIG. 2A is a longitudinal cross-sectional view taken along line 2A—2A of FIG. 1;

FIG. 2B is a cross-sectional view taken along line 2B—2B of FIG. 1;

FIG. 3 is a plan view of the application face of the applicator device of FIG. 1;

Reference will now be made in detail to the present preferred embodiments of the invention, examples of which are illustrated in the accompanying drawings. Wherever possible, the same reference numbers are used in the drawings and the description to refer to the same or like parts.

Figure 1:
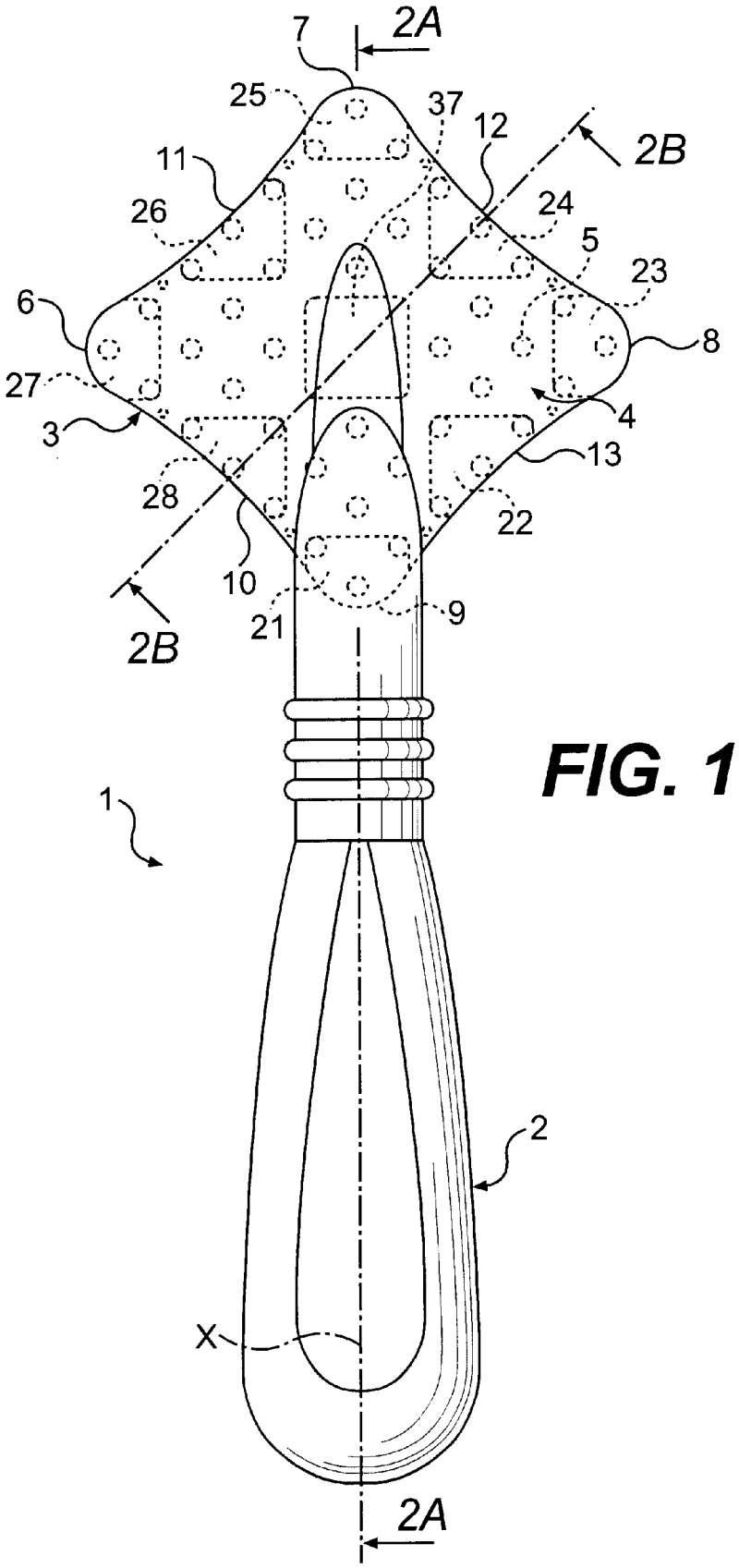

As embodied herein and shown in FIG. 1, the applicator 1 includes a handle 2, one end of which is formed integrally with a brush 3 having a support 4. The support 4 has an application face 14. A plurality of brush members 5 extend from support 4 at right angles to the support 4. Brush members 5 may include teeth or bristles arranged in the form of tufts. The brush members 5 are arranged in rows formed at an approximately 45° angle with respect to the axis X of the handle 2. The profile of the handle 2 of the applicator is chosen so as to make it as ergonomic as possible, with a view to optimizing application. The applicator 1 is obtained by molding a thermoplastic, preferably one which is not elastically deformable, such as a polyethylene or a polypropylene.

The support 4 is formed in approximately a diamond (or square) shape with four corners 6, 7, 8, 9. Two of the corners 6, 8 are arranged opposite one another and are preferably aligned along an axis perpendicular to the axis X of the handle 2. The other two corners 7, 9 are also arranged opposite one another and are preferably arranged along the axis X of the handle. The corners 6–9 are preferably rounded. The radius of curvature formed by the corners 6–9 is preferably on the order of 5 mm. The edges 10–13 of the support 4, connecting the corners in twos, are of slightly concave shape, so as to make the application all the more natural, by producing a leading edge with no straight portions with handle 2.

The application face 14 of the applicator device 1 according to one embodiment of the invention forms three distinct "steps". The first step includes the bottom surface 20, the shape of which is preferably convex, the brush members 5 extending from the convex face of the bottom surface 20. By way of example, the radius of curvature formed by the bottom is preferably on the order of 10 cm. The free ends of the brush members 5 define an envelope surface of concave shape, the brush members 5 being arranged on the convex side of the surface. The radius of curvature of this surface may, by way of indication, be of the order of 10 cm.

The second "step" includes a first group of blocks 21–28 formed at the four corners 6–9 of the application face 14 and at the middle of each edge 10–13 of the application face 14. One face 29–36 of each of the first group of blocks 21–28 is contained on a surface which is "concentric" with the convex surface formed by the bottom surface 20. That is, the first group of blocks preferably has the same radius of curvature as the convexity of the bottom surface 20, such that the blocks also have a convex surface with the same degree of convexity as the base surface 20. The four corner blocks 21, 23, 25, 27 are preferably of approximately semicircular cross section. The blocks 22, 24, 26, 28 located at the middle of each of the edges 11–14 of the application face 14 preferably form a right-angled isosceles triangle, the right angle of which is preferably arranged on the inside of the application face 14, and directed towards the geometric center of the application face 14.

The faces 29–36 of blocks 21–28 form intermediate surface portions at a height that is between the bottom surface 20 and the free end of the brush members 5, i.e., the height of the intermediate surface portions is greater than the height of bottom surface 20 and less than the height of the free ends of the brush members 5. Preferably, brush members 5 may also project from each of these blocks 21–28. By way of indication, such brush members may project by an amount ranging from 3 mm to about 5 mm from blocks 21–28.

The third "step" is preferably formed at the center of the application face 14 as a block 37 of which one face 38 is slightly concave and passes through the concave envelope surface formed by the free end of the brush members 5. There preferably is no brush member emerging from this face 38. The "actual" height of the block 37 is identical to the height of the blocks 21–28. However, since the block 37 is located at the "top" of the convex surface formed by the bottom surface 20, whereas the blocks 21–28 are located at the "base" of this same surface, the face 38 is raised with respect to the faces 29–36 and forms a second raised surface portion with a "relative" height greater than that of the intermediate surface portions (blocks 21–28). The block 37 is of approximately square cross section with its longitudinal axis offset at 45° with respect to the cross section of the square formed by the application face. Its width is identical to the width of the corner blocks 21, 25, measured along an axis perpendicular to the axis of the handle 2.

The blocks 21–28 are spaced apart by a distance which corresponds to the distance between two rows of brush members 5 and form, in combination with the central block 37 and the bottom surface 20, a number of so-called "intense coloration" recessed regions or portions 47–58 running continuously and in a straight line between two edges of the application face 14. The recessed portions open onto the two corresponding edges of the application face 14 via passages 39–46 formed between two adjacent blocks of the first group of blocks 21–28.

Two types of recessed portions are formed with the configuration of the application face 14 as depicted according to this advantageous embodiment of the present invention. For reasons of clarity, the first group of recessed portions 47–54 has been depicted diagrammatically in FIG. 4A, the second group 55–58 having been depicted diagrammatically in FIG. 4B. The first group is made up of eight recessed portions of which four, 47–50, are perpendicular to the axis X of the handle, and of which four, 51–54, are parallel to the axis X of the handle. Each of these eight recessed portions of the first group opens onto a first edge of the application face 14 and onto a second edge of the application face 14, adjacent to the first edge.

The second group of recessed portions is made up of four recessed regions, of which two, 55, 56, are parallel to two opposed edges of the application face 14, the other two, 57, 58, being perpendicular to the first two. Each of these four recessed portions of the second group opens onto a first edge of the application face 14 and onto a second edge of the application face opposite the first edge and does so via the same passages 39–46 via which the recessed portions 47–54 of the first group open.

The recessed regions of the first group 47–54 are smaller in width than the recessed regions of the second group 55–58. By way of example, the recessed regions of the first group are on the order of 1 mm wide, while the recessed portions of the second group are on the order of 5 mm wide. Each of the passages 39–46, at its center and near the edge of the application face which is adjacent to it, has a brush member 59–66 capable of playing a part in holding the product on the application face 14. Such a brush member may have a diameter, at its base, on the order of 1 mm, and a height on the order of 5 mm.

To use the applicator according to the invention, the user turns the brush 1 over in the way depicted in FIG. 3, and deposits the product in the form of a cream or of a gel on the application face 14. The product fills the recessed portions of the application face 14 and spills over slightly onto the edge blocks 21–28. The central block 37, which is raised with respect to the others, carries practically no product and in any event does not carry product in sufficient quantity to visibly color a section of hair. She then turns the applicator 1 back over and brings it into contact with her hair, particularly by applying the free end of the brush members 5 against her head. She then moves the applicator along the hair from the roots of the hair to the tips.

Different coloration patterns are obtained according to the direction in which the brush 1 is moved with respect to the hair. Thus, if the applicator 1 is moved in the way illustrated by the arrows F1 or F2 in FIG. 4A, a pattern of contiguous hair sections, made up of a lightly colored sections of hair 100, a narrow intensely colored section of hair 101, a lightly colored section of hair 102, a narrow intensely colored section of hair 103, an uncolored section of hair 104, a narrow intensely colored section of hair 105, a lightly colored section of hair 106, a narrow intensely colored section of hair 107 and a lightly colored section of hair 108 is obtained across a width which corresponds to the width of a diagonal of the application face 14.

Figure 4A:
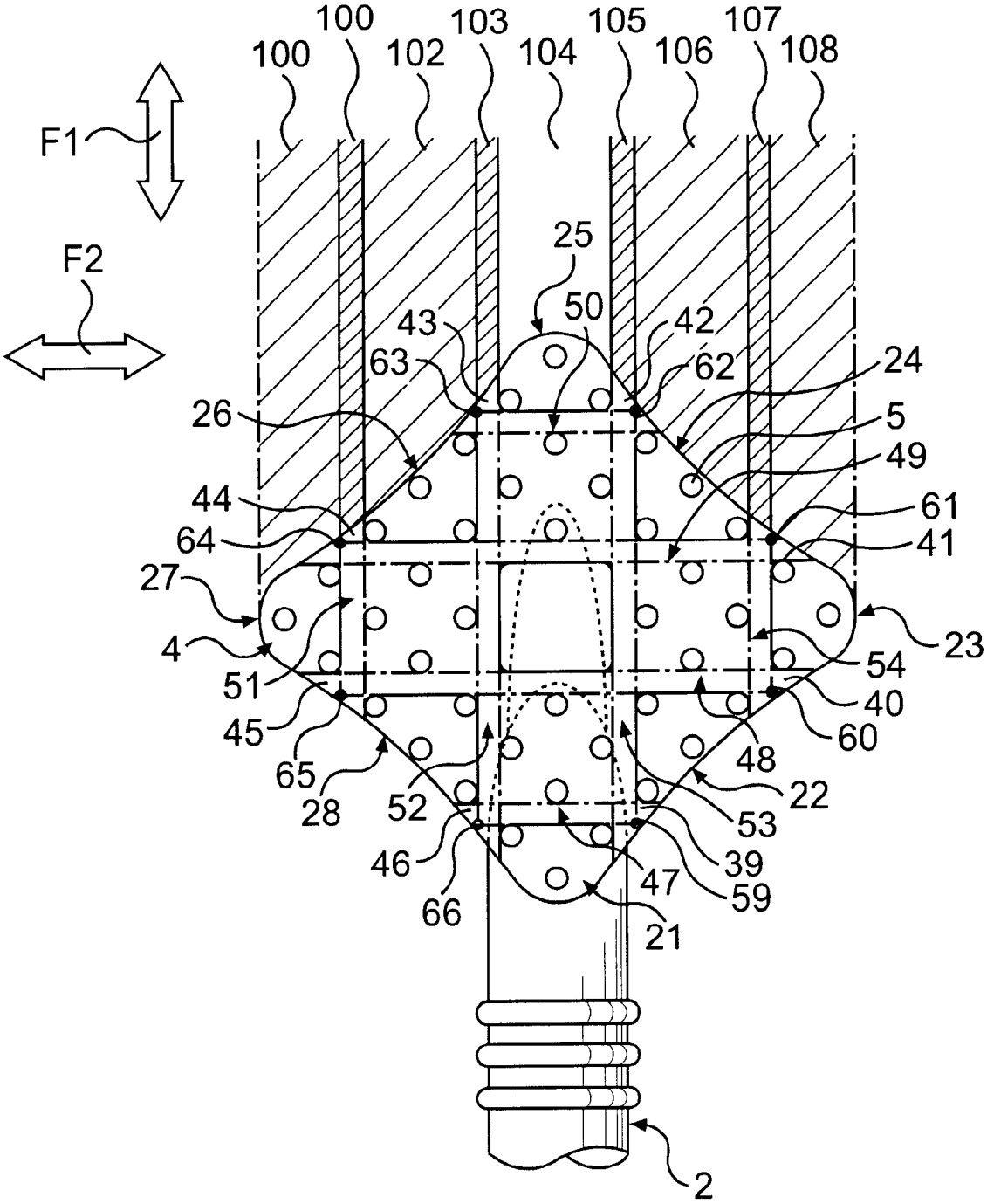
FIGS. 4A and 4B are bottom views of the application face of the applicator device of FIG. 1, illustrating the coloration patterns obtained according to the orientation of the application face and/or to the direction in which the device is moved through the hair.
Figure 4B:
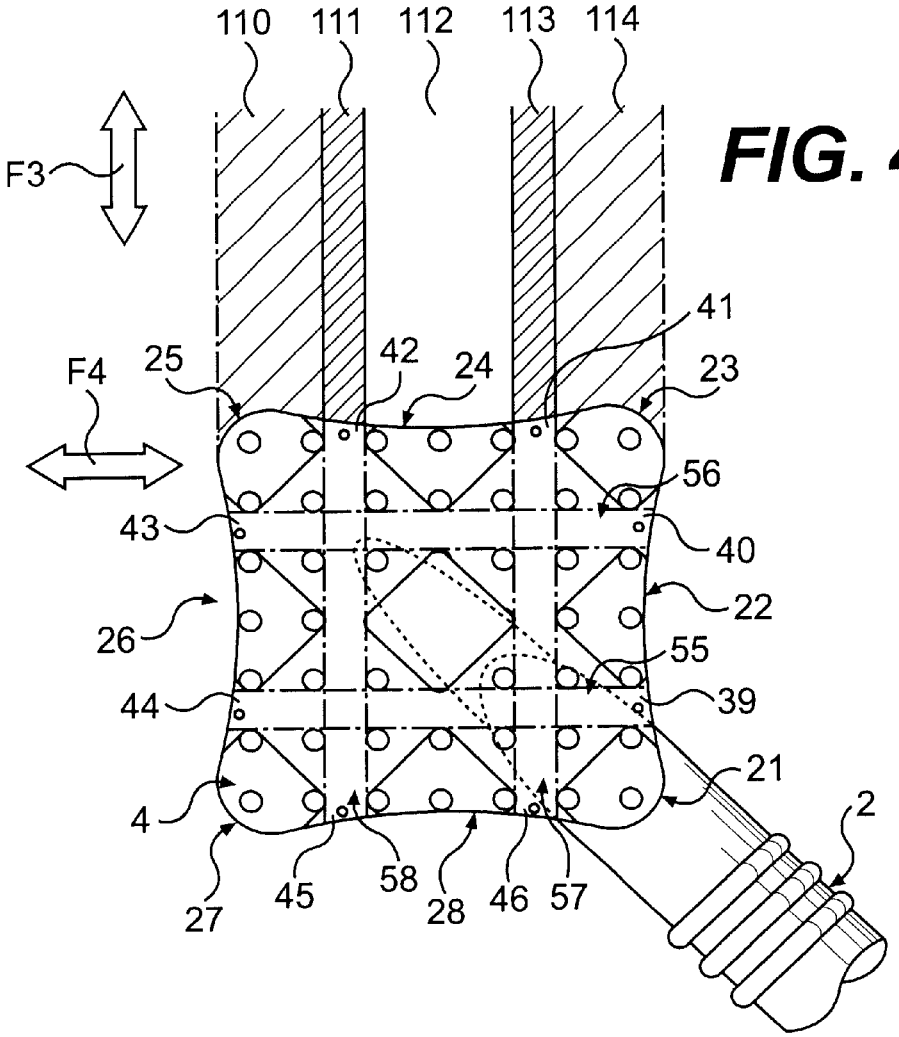

By contrast, if the applicator 1 is moved in the way illustrated by the arrows F3 or F4 in FIG. 4B, a pattern of contiguous hair sections made up of a lightly colored section of hair 110, an intensely colored section of hair 111 wider than the intensely colored hair section of FIG. 4A, a section of hair 112 with no appreciable coloration, an intensely colored section of hair 113 the same width as the section of hair 111, and a lightly colored section of hair 114 is obtained across a width corresponding to the width of the sides of the application face 14.

From the description just given of the preferred embodiment of the invention it is clear that the coloration pattern obtained by means of the applicator device according to the invention can be altered as desired simply by altering the stepped profile of the application face 14 and/or the direction in which the device is moved through the hair.

Figure 5:
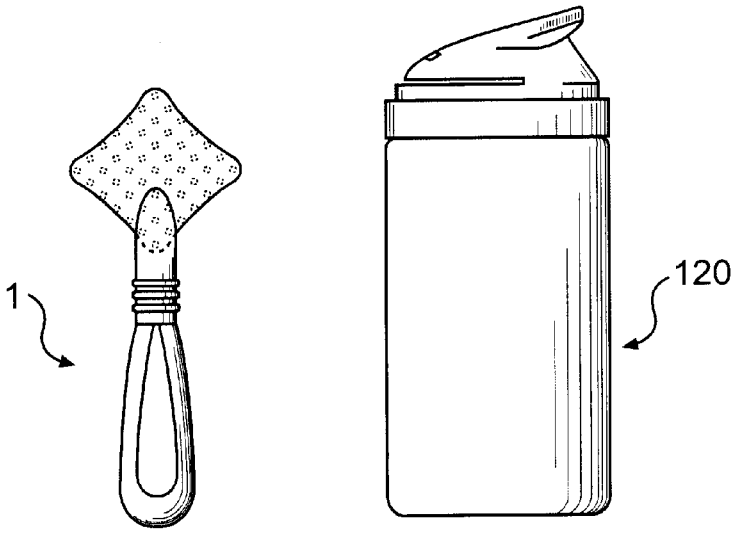
FIG. 5 is a perspective view of one embodiment of an application kit according to the present invention.

FIG. 5 depicts an application kit including an applicator 1 of the type described with reference to the preceding figures, combined with a container device in the form of a pressurized container 120 intended to deliver a foam that is to be applied to the hair using the applicator 1. Alternatively, the container device may include of a bowl in which the composition to be applied is prepared by hand (typically by mixing a colorant and an oxidant) or a mixing device capable of automatically mixing the constituents which make up the coloration composition. Such mixing devices have been covered by many descriptions in patent literature and therefore require no additional description.

It will be apparent to those skilled in the art that various modifications and variations can be made to the structure and methodology of the present invention without departing from the scope or spirit of the invention. Thus, it should be understood that the invention is not limited to the examples discussed in the specification. Rather, the present invention is intended to cover modifications and variations of this invention, provided they fall within the scope of the following claims and their equivalents.

What is claimed is:

1. An applicator for a hair coloring product, comprising:

a support including an application face impermeable to the hair coloring product, and an array of brush members on the application face, the application face being configured to at least temporarily hold the hair coloring product and having a stepped profile including at least two discrete levels impermeable to the hair coloring product, the levels being configured such that contact of the application face with hair to be colored and movement of the application face between roots and tips of the hair to be colored generates on the hair a coloration pattern including at least two sections of hair having differing degrees of coloration.

2. The applicator of claim 1, wherein the coloration pattern includes at least one colored section of hair and at least one substantially uncolored section of hair.

3. The applicator of claim 2, wherein the stepped profile includes at least three discrete levels and wherein the coloration pattern further includes at least a third section of hair having a degree of coloration between that of the colored section of hair and the uncolored section of hair.

4. The applicator of claim 1, wherein the stepped profile of the application face is configured such that the coloration pattern varies according to the orientation of the support.

5. The applicator of claim 1, wherein the stepped profile of the application face is configured such that the coloration pattern varies according to the direction in which the support is moved.

6. The applicator of claim 2, wherein the stepped profile of the application face is configured such that the coloration pattern, including the number of sections having differing degrees of coloration, varies according to at least one of the movement and the orientation of the support.

7. The applicator of claim 6, wherein the stepped profile of application face is configured such that width of the sections of hair having differing degrees of coloration varies according to at least one of the movement and the orientation of the support.

8. The applicator of claim 1, wherein each of the brush members forms approximately a right angle to a plane of the support, and wherein free ends of the brush members are configured to form a concave contour.

9. The applicator of claim 1, wherein the application face includes a base surface, at least one recessed portion, and a number of intermediate surface portions, each intermediate surface portion being on a respective raised portion, each intermediate surface portion having a height partway between that of the base surface and that of free ends of the brush members extending from the base surface.

10. The applicator of claim 9, wherein the intermediate surface portions are separated from one another by a portion of the base surface.

11. The applicator of claim 9, wherein the intermediate surface portions are non-contiguous.

12. The applicator of claim 9, wherein the application face further includes at least one second surface portion on at least one second raised portion, wherein the intermediate surface portions are at a mean height between that of the base surface and that of the second surface portion.

13. The applicator of claim 12, wherein the at least one second surface portion is configured to form a concave contour along with free ends of the brush members extending from the base surface.

14. The applicator of claim 9, wherein the base surface is convex.

15. The applicator of claim 1, wherein the application face includes a convex base surface.

16. The applicator of claim 14, wherein the intermediate surface portions are concentric with the base surface.

17. The applicator of claim 9, wherein the at least one recessed portion forms an intense coloration region which extends continuously between two points on a periphery of the support, and wherein the at least one recessed portion opens to the periphery of the support via a passage formed between two raised portions of the application face.

18. The applicator of claim 17, wherein the passage includes at least one retention element to enhance retention of the hair coloring product on the base surface.

19. The applicator of claim 18, wherein the retention element includes at least one tooth arranged in an approximate center of the passage.

20. The applicator of claim 1, wherein the support is integrally formed with a handle having a longitudinal axis, and wherein the application face is generally square in shape and is formed such that two corners of the square are aligned along the longitudinal axis of the handle.

21. The applicator of claim 20, wherein the brush members are arranged in rows, and wherein the rows are formed at an angle of about 45 degrees with respect to the longitudinal axis of the handle.

22. The applicator of claim 9, wherein the support is integrally formed with a handle having a longitudinal axis, and wherein the application face is substantially square in shape and is formed such that two corners of the square are aligned along the longitudinal axis of the handle.

23. The applicator of claim 22, wherein the brush members are arranged in rows, and wherein the rows are formed at an angle of about 45 degrees with respect to the longitudinal axis of the handle.

24. The applicator of claim 23, wherein the application face is configured such that an intermediate surface portion is located at each corner of the application face.

25. The applicator of claim 23, wherein the application face is configured such that an intermediate surface portion is located along each side of the application face.

26. The applicator of claim 25, wherein the intermediate surface portions are located at an approximate center of each side of the application face.

27. The applicator of claim 23, wherein the application face is configured such that an intermediate surface portion is located at each corner of the application face and along each side of the application face.

28. The applicator of claim 27, wherein the intermediate surface portions are located at an approximate center of each side of the application face.

29. The applicator of claim 27, wherein the second surface portion is located at an approximate center of the application face.

30. The applicator of claim 29, wherein the second surface portion is square in shape, and wherein corners of the second surface portion are offset 45 degrees from the corners of the application face.

31. The applicator of claim 17, wherein the application face includes eight first intense coloration regions, extending continuously and in pairs, from one edge of the application face to another adjacent edge of the application face.

32. The applicator of claim 31, wherein the application face further includes four second intense coloration regions, extending continuously and in pairs, from one edge of the application face to another opposite edge of the application face.

33. The applicator of claim 31, wherein the edges of the application face are slightly concave.

34. The applicator of claim 32, wherein the edges of the application face are slightly concave.

35. The applicator of claim 1, wherein the applicator is formed of a material comprising a molded thermoplastic.

36. The applicator of claim 35, wherein the thermoplastic is chosen from polyethylene and polyproplyene.

37. The applicator of claim 1, wherein the brush members are chosen from teeth and bristles.

38. The applicator of claim 37, wherein the brush members include tufts of bristles.

39. A kit for applying a hair coloring product to hair, comprising:

a) the applicator of claim 1; and b) a container for containing the hair coloring product.

40. The kit of claim 39, wherein the container comprises one of a bowl, a mixer, and a pressurized container.

41. A method of applying a hair coloring product to hair with an applicator having an application face and brush members on the application face, the application face having a stepped profile including at least two discrete levels, comprising:

placing the hair coloring product on the application face;

positioning the applicator such that the application face faces the hair to be colored;

contacting the hair to be colored with the application face; and moving the applicator between roots of the hair and tips of the hair to transfer the hair coloring product from the application face to the hair and thereby produce a coloration pattern including at least two sections of hair having differing degrees of coloration.

42. The method of claim 41, wherein the placing of the hair coloring product on the application face includes placing differing amounts of the hair coloring product on differing regions of the application face.

43. The method of claim 41, further including separating the hair into the sections as the applicator moves through the hair to be colored.

44. The method of claim 43, wherein the separating includes passing at least one section of hair in at least one recessed portion of the application face to produce an intensely colored section of hair.

45. The method of claim 41, wherein the contacting includes contacting at least one section of hair with an intermediate surface portion of the application face to produce a lightly colored section of hair.

46. The method of claim 41, wherein the contacting includes contacting a section of hair with a second surface portion of the application face to produce a substantially non-colored section of hair.

47. The method of claim 41, wherein the coloration pattern includes at least one section of intensely colored hair, at least one section of lightly colored hair, and one section of substantially non-colored hair.

48. The method of claim 47, wherein the coloration pattern includes two sections of intensely colored hair, two sections of lightly colored hair, and one section of substantially non-colored hair.

49. The method of claim 41, further comprising varying the coloration pattern by changing a direction in which the applicator is moved with respect to the hair to be colored.

50. The method of claim 41, further comprising varying the coloration pattern by changing the orientation of the application face with respect to the hair to be colored.

51. An applicator for a hair coloring product, comprising:

an application face having a base surface;

brush members on at least a portion of said base surface;

a raised center surface portion on the application face; and at least one intermediate surface portion on the application face located in a plane between a plane of said base surface and a plane of said center surface portion.

52. The applicator of claim 51, wherein the base surface is convex.

53. The applicator of claim 51, wherein the brush members face in a substantially same direction.

54. The applicator of claim 51, wherein the brush members are chosen from teeth and bristles.

55. The applicator of claim 51, wherein the application face is generally square in shape and wherein the at least one intermediate surface portion comprises an intermediate surface portion located on each corner of the application face.

56. The applicator of claim 55, wherein the at least one intermediate surface portion further comprises an intermediate surface portion centered along each edge of the application face.

57. The applicator of claim 51, further comprising at least one brush member on the at least one intermediate surface portion.

58. The applicator of claim 51, further comprising several intermediate surface portions located on the application face.

59. The applicator of claim 58, wherein the intermediate surface portions are separated from one another by at least one portion of the base surface.

60. The applicator of claim 58, wherein the intermediate surface portions are non-contiguous.

61. An applicator for a hair coloring product, comprising:

a handle;

a support on said handle, said support including an application face configured to at least temporarily hold the hair coloring product and having a stepped profile including a base surface, at least one intermediate surface portion, and an upper surface portion configured to produce a coloration pattern including at least two sections of hair having differing degrees of coloration on hair to be colored, wherein the upper surface portion extends further than the intermediate surface portion from a plane of the support; and at least one brush member on said at least one intermediate surface portion.

62. The applicator of claim 61, wherein the application face is configured such that contact of the base surface, the intermediate surface portion, and the upper surface portion with hair to be colored and movement of the application face between roots and tips of the hair to be colored generates the coloration pattern on the hair.

63. The applicator of claim 61, wherein the coloration pattern includes at least one colored section of hair and at least one substantially uncolored section of hair.

64. The applicator of claim 63, wherein the coloration pattern further includes at least a third section of hair having a degree of coloration between that of the colored section of hair and the uncolored section of hair.

65. The applicator of claim 61, wherein the stepped profile of the application face is configured such that the coloration pattern varies according to the orientation of the support.

66. The applicator of claim 61, wherein the stepped profile of the application face is configured such that the coloration pattern varies according to the direction in which the support is moved.

67. The applicator of claim 61, further comprising brush members on the base surface of the application face.

68. The applicator of claim 67, wherein the brush members are chosen from teeth and tufts of bristles.

69. The applicator of claim 67, further comprising brush members on the at least one intermediate surface portion.

70. The applicator of claim 61, wherein the application face includes at least one recessed portion, and a number of intermediate surface portions, each intermediate surface portion being on a respective raised portion, each intermediate surface portion having a height greater than the base surface and less than the upper surface portion.

71. The applicator of claim 70, wherein the intermediate surface portions are separated from one another by at least one portion of the base surface.

72. The applicator of claim 70, wherein the intermediate surface portions are non-contiguous.

73. The applicator of claim 70, wherein the at least one recessed portion forms an intense coloration region which extends continuously between two points on a periphery of the application face, and wherein the at least one recessed portion opens to the periphery of the application face via a passage formed between two raised portions of the application face.

74. The device of claim 73, wherein the passage includes at least one retention element to enhance retention of the hair coloring product on the base surface.

75. The device of claim 73, wherein the application face includes eight first intense coloration regions, extending continuously and in pairs, from one edge of the application face to another adjacent edge of the application face.

76. The applicator of claim 75, wherein the application face further includes four second intense coloration regions, extending continuously and in pairs, from one edge of the application face to another opposite edge of the application face.

77. An applicator for a hair coloring product, comprising:

a handle; and a support on said handle, said support including an application face configured to at least temporarily hold the hair coloring product and having a stepped profile including a base surface, at least one intermediate surface portion, and an upper surface portion configured to produce a coloration pattern including at least two sections of hair having differing degrees of coloration on hair to be colored, wherein the upper surface portion extends further than the intermediate surface portion from a plane of the support, wherein the coloration pattern includes at least one colored section of hair, at least one substantially uncolored section of hair, and at least a third section of hair having a degree of coloration between that of the colored section of hair and the uncolored section of hair.

78. An applicator for a hair coloring product, comprising:

a handle; and a support on said handle, said support including an application face configured to at least temporarily hold the hair coloring product and having a stepped profile including a base surface, at least one intermediate surface portion, and an upper surface portion configured to produce a coloration pattern including at least two sections of hair having differing degrees of coloration on hair to be colored, wherein the upper surface portion extends further than the intermediate surface portion from a plane of the support, wherein the application face includes at least one recessed portion, and a number of intermediate surface portions, each intermediate surface portion being on a respective raised portion, each intermediate surface portion having a height greater than the base surface and less than the upper surface portion.

79. A kit for applying a hair coloring product to hair, comprising:

the applicator of claim 51; and a container for containing the hair coloring product.

80. A kit for applying a hair coloring product to hair, comprising:

the applicator of claim 61; and a container for containing the hair coloring product.

81. The applicator of claim 1, wherein the at least two discrete levels contact the hair to generate the hair coloration pattern.

* * * * *

UNITED STATES PATENT AND TRADEMARK OFFICE

CERTIFICATE OF CORRECTION

PATENT NO. : 6,453,909 B1
DATED : September 24, 2002
INVENTOR(S) : Vincent De Laforcade It is certified that error appears in the above-identified patent and that said Letters Patent is hereby corrected as shown below:

Title page,
Item [57], ABSTRACT,
Line 6, after "is capable", insert -- of --.

Column 11,
Line 28, "polyproplyene" should read -- polypropylene --.

Signed and Sealed this

Thirteenth Day of May, 2003

JAMES E. ROGAN
*Director of the United States Patent and Trademark Office*